United States Patent [19]

Embinder

[11] 4,012,051

[45] Mar. 15, 1977

[54] GOLF CLUB CARRIER

[76] Inventor: Donald N. Embinder, 1029 Harrison St., Hollywood, Fla. 33020

[22] Filed: Dec. 23, 1975

[21] Appl. No.: 643,862

[52] U.S. Cl. ..... 280/47.19; 280/DIG. 6

[51] Int. Cl.[2] ..... B62B 1/20

[58] Field of Search ..... 280/47.19, 47.17, DIG. 6, 280/26; 150/1.5 R, 1.5 B

[56] References Cited

UNITED STATES PATENTS

| | | | |
|---|---|---|---|
| 3,550,999 | 12/1970 | Bogan | 280/DIG. 6 |
| 3,606,372 | 9/1971 | Browning | 280/47.17 |

*Primary Examiner*—Joseph F. Peters, Jr.
*Assistant Examiner*—R. Schrecengost
*Attorney, Agent, or Firm*—Jack D. Slobod

[57] ABSTRACT

A rigid-walled golf bag has a wheel well formed at its base in which are rotably mounted the integral axle of a pair of wheels. The wheel well is formed by a skirt extension of the walls of the bag which serve as a rest when the bag is upright. Plural integral walls divide the bag into plural club compartments and an auxiliary storage compartment is accessed through a door pivotly mounted along one wall. A plate is mounted in a track along the top of the golf bag. The plate is moveable for either covering the club compartments or projecting outward. The plate includes an aperture to permit the plate to serve as a pulling handle for the golf bag.

5 Claims, 4 Drawing Figures

GOLF CLUB CARRIER

FIELD OF THE INVENTION

The present invention relates to golf bags and wheeled golf bag holders. In its particular aspects, the present invention relates to a rigid walled golf bag which has a tractive wheel carried in a wheel well therein.

BACKGROUND OF THE INVENTION

Generally wheeled carriers or hand carts are provided for transporting a flexible walled golf bag. Motorized electric carts are becoming increasingly prevalent for transporting golfers and their golf bags. I am not aware of any golf bag or combined golf bag and carrier which is configured to be either carried on a motorized cart or wheeled about a playing area.

OBJECTS OF THE INVENTION

It is an object of the present invention to provide a golf bag having its own wheels which are positioned in a manner to enable the bag to be carried in the usual space provided therefor in an electric golf cart.

It is a further object of the present invention to provide a wheeled golf bag which has a non-protruding rest.

It is yet another object of the present invention to provide a lid on a wheeled golf bag which lid may be utilized as a handle.

It is still another object of the present invention to provide a golf bag which is compartmented for the storage of clubs and other articles.

SUMMARY OF THE INVENTION

Briefly, the aforementioned and other objects of the present invention are satisfied by providing a rigid-walled golf bag in which a skirt extension of the sidewalls of the bag are provided at the bottom thereof to define a wheel well. A pair of wheels having a common integral axle are mounted in the well and are provided of a diameter that the skirts acts as a rest when the bag is oriented vertically.

A plurality of elongated compartments are formed by dividing walls within the bag for club storage, and another elongated compartment for the storage of other articles in the bag is accessed via a door pivotly mounted at a sidewall of the bag.

For selectively covering or uncovering the top of the golf bag, a plate is mounted in a track. When the plate is moved to one extreme of the track, the plate projects outward to serve as a handle for pulling and inclining the cart.

Other objects, features and advantages of the present invention will become apparent upon perusal of the following detailed description of the preferred embodiment thereof when taken in conjunction with the appended drawing wherein.

DETAILED DESCRIPTION

Figure 1:
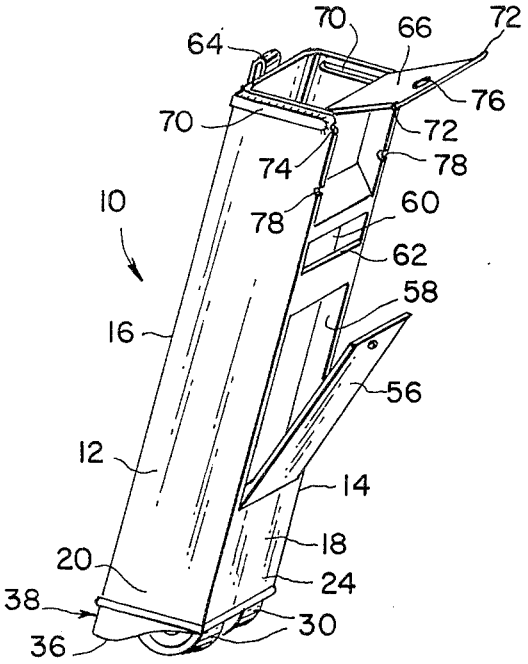
FIG. 1 is a pictorial presentation of the golf club carrier of the present invention showing the carrier positioned to be moved.

Referring to FIGS. 1 through 4 of the drawing, the golf club carrier of the present invention is generally indicated by the reference numeral 10.

Carrier 10 is generally in the shape of a golf bag, but is formed of rigid left and right planar sidewalls 12 and 14 and a rigid curved front sidewall 16 merging smoothly with sidewalls 12 and 14, and a rigid rear sidewall 18. As will be understood as the discussion proceeds, the various sidewalls are formed of a rigid material such as plastic so that the carrier 10 may be self-supporting on its own wheels 30. Straight downward extensions 20, 22 and 24 of the respective sidewalls 12, 14 and 18 below a forwardly and downwardly curving bottom wall 26 of carrier 10 define a wheel well 28. A pair of wheels 30, which are formed with an integral common axle 32 are rotatably mounted in wheel well 28 to enable the carrier 10 to be rolled along the ground 34.

Figure 2:
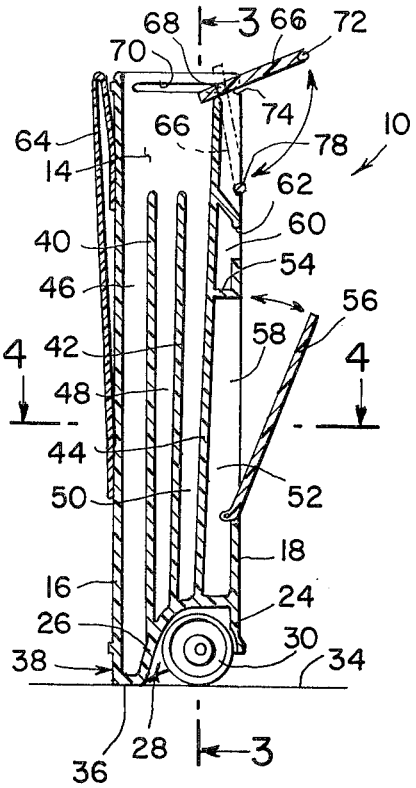
FIG. 2 is a side cross-sectional elevation view of the golf club carrier of FIG. 1, but positioned at rest.

The bottom wall 26 has a flat portion 36 at its lower extremity which is positioned relative to wheels 30 to serve as a rest when the carrier 10 is oriented upright, as illustrated in FIG. 2. The various sidewall portions below the upper extremity of bottom wall 26 serve as a skirt 38 surrounding the wheels 30 to prevent grass from becoming entangled therein. The formation of the axle 32 integral with wheels 30 also minimizes the possibility of grass entanglement.

As should be apparent from FIG. 2, the carrier 10, when upright, will rest both on wall portion 36 and on wheels 30, stopping the carrier from rolling. To enable movement of the carrier 10 along the ground 34, the carrier is pivoted about axle 32 and inclined rearward, as shown in FIG. 1, lifting skirt 38 off the ground. In this orientation, the carrier may be rolled on wheels 30.

Three parallel spaced dividing walls 40, 42 and 44 which are preferably molded integrally with the sidewalls of carrier 10, span between sidewalls 12 and 14 to divide the carrier into three separate vertically elongated compartments 46, 48 and 50 for golf clubs or different range characteristics, and closed storage compartment 52 for other articles. The compartments 46 through 50 are accessed from the open top of carrier 10.

The closed storage compartment 52 is formed between dividing wall 42 and rear wall 18. Compartment 52 is closed at its top by a short wall 54 directed perpendicularly between walls 18 and 42. A door 56 is pivotly supported at the bottom of a rectangular opening 58 in rear wall 18 for enabling access to compartment 52. Wall 52 also forms a bottom wall of an open storage compartment 60 which is accessed through another rectangular opening 62 in wall 18.

To enable the carrier 10 to be carried by a golfer in the same manner as a golf bag, a shoulder strap 64 is secured to front sidewall 16.

Figure 3:
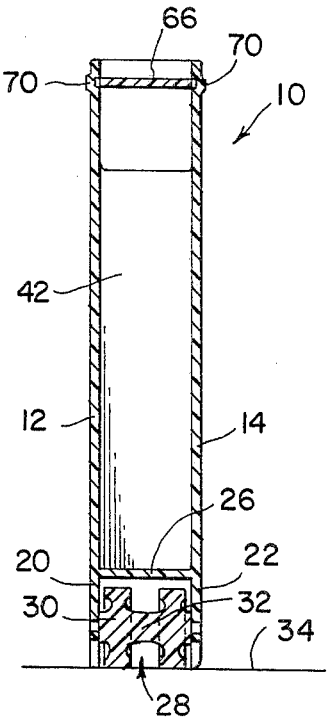
FIG. 3 is a cross-sectional elevation view along the lines 3—3 in FIG. 2.
Figure 4:
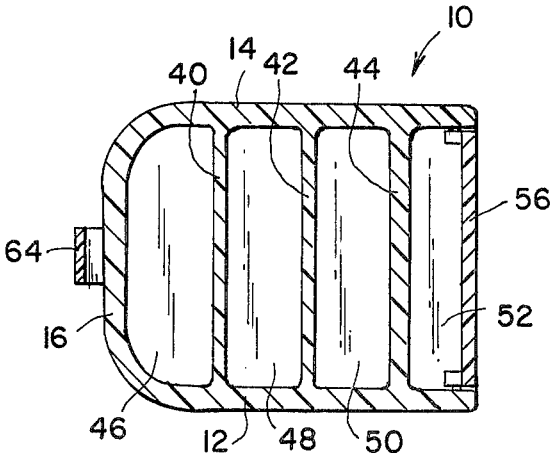
FIG. 4 is a cross-sectional top view along the lines 4—4 in FIG. 2.

The golf club compartments 46-50 are selectively covered by a plate 66. A pair of cylindrical bosses 68 project from opposite sides of plate 66 along one edge thereof and are engaged in horizontally elongated slots 70 along the top of sidewalls 12 and 14. When the plate 66 is positioned with bosses 66 at the forward extreme of slots 70, bosses 72, projecting from opposite sides of plate 66 at an edge opposite that carrying bosses 68, may be positioned in rearwardly directed notches 74 in sidewalls 12 and 14. The notches 74 are in line with slots 70 so that plate 66 may be locked in place as a protective lid for the top of the carrier 10 as shown in FIG. 3.

Furthermore, an opening 76 is formed in plate 66 near the edge of the plate from which bosses 72 project. The plate 66 may be positioned with bosses 68 at a rearward extreme of slots 70, as shown in FIGS. 1 and 2, and a hand may be inserted through opening 76 whereby the plate serves as a handle for tilting carrier 10 backwards and at the same time pulling the carrier along the ground.

For locking plate 72 out of the way to permit access to the club compartments 46–50, a pair of notches 78 are provided directly below notches 74 for receiving bosses 72 when bosses 68 are in the rearward extreme of slot 70, in a manner indicated in dashed line in FIG. 2.

While the preferred embodiment of the present invention has been described and illustrated in specific detail, it should be understood that numerous modifications, additions and omissions in the details thereof are possible within the intended spirit and scope of the invention claimed herein.

What is claimed is:

1. A golf club carrier device comprising: an elongated rigid walled golf bag; ground engaging wheel means rotatably mounted on the bottom of said golf bag; rest means projecting downward from the bottom of said golf bag for engaging the ground when said bag is in substantially upright orientation; and plate means movably mounted at the top of said golf bag for selectively either being positioned for covering said golf bag or being positioned to serve as a handle for translating said golf bag on said wheel means.

2. The device of claim 1 wherein said wheel means comprises a pair of wheels formed integrally with a common axle.

3. The device of claim 1 further comprising first plural elongated club storage compartments formed in said golf bag, said compartments being positioned to be covered by said plate means.

4. The device of claim 3 further comprising second storage compartment means formed in said golf bag, and a door pivotly mounted along a wall of said golf bag to permit access to said second storage compartment means.

5. The device of claim 2 wherein said rest means is formed by a skirt extension of said golf bag walls; said skirt defining a wheel well in which said wheel means is mounted.

* * * * *